US005738060A

United States Patent [19]

Colo et al.

[11] Patent Number: 5,738,060

[45] Date of Patent: Apr. 14, 1998

[54] POPPET VALVE AND METHOD OF MAKING THE POPPET VALVE

[75] Inventors: Robert J. Colo, Painsville; William Neumann, Lakewood, both of Ohio

[73] Assignee: TRW Inc., Lyndhurst, Ohio

[21] Appl. No.: 865,201

[22] Filed: May 29, 1997

[51] Int. Cl.[6] ..... F01L 3/02

[52] U.S. Cl. ..... 123/188.3; 123/188.11; 29/888.452

[58] Field of Search ..... 123/188.3, 188.11; 29/888.4, 888.45, 888.46, 888.452

[56] References Cited

U.S. PATENT DOCUMENTS

| | | | |
|---|---|---|---|
| 1,498,583 | 6/1924 | Spire . | |
| 1,789,374 | 1/1931 | Sullivan . | |
| 2,119,042 | 5/1938 | Charlton . | |
| 2,238,628 | 4/1941 | Daisley . | |
| 2,294,803 | 9/1942 | Rich . | |
| 2,407,561 | 9/1946 | Lincoln . | |
| 2,610,279 | 9/1952 | Perkes . | |
| 2,627,259 | 2/1953 | Wood et al. . | |
| 3,233,599 | 2/1966 | Schober . | |
| 3,604,034 | 9/1971 | Leistner . | |
| 4,597,367 | 7/1986 | Hayashi | 123/188.3 |
| 5,056,219 | 10/1991 | Iwase | 123/188.3 |
| 5,169,460 | 12/1992 | Mae | 123/188.3 |
| 5,370,092 | 12/1994 | Shimizu et al. | 123/188.3 |

FOREIGN PATENT DOCUMENTS

| | | | |
|---|---|---|---|
| 54-44122 | 4/1979 | Japan | 29/888.45 |
| 59-45044 | 3/1984 | Japan | 29/888.44 |
| 4-183908 | 6/1992 | Japan | 29/888.4 |
| 167620 | 7/1959 | Sweden | 29/888.452 |

*Primary Examiner*—Erick R. Solis
*Attorney, Agent, or Firm*—Tarolli, Sundheim, Covell, Tummino & Szabo

[57] ABSTRACT

A poppet valve (10) includes an elongated valve stem (14) with first and second ends (22, 26). A valve head (12) is located at the first end (22) of the stem (14). A valve tip (24) is fixed to the second end (26) of the stem (14). The tip (24) is constructed as an axially compressed piece of steel wire (32).

6 Claims, 1 Drawing Sheet

POPPET VALVE AND METHOD OF MAKING THE POPPET VALVE

FIELD OF THE INVENTION

The present invention relates to a poppet valve for use in an internal combustion engine.

BACKGROUND OF THE INVENTION

A poppet valve for use in an internal combustion engine has a disc-shaped head on the end of an elongated stem. A rim surface of the head comprises the valve surface which engages a valve seat in the engine. The valve further has a tip at the opposite end of the stem. A part in the engine, such as a cam or lever, acts against the tip to move the valve longitudinally, and thereby to open and close the valve. The tip of the valve is formed of a relatively hard metal material to resist wear caused by sliding movement of the engine part against the valve. It is known to form poppet valve tips in a milling process or by stamping the tips from sheet metal.

SUMMARY OF THE INVENTION

In accordance with the present invention, a poppet valve comprises an elongated valve stem having first and second ends. A valve head is located at the first end of the stem. A valve tip is fixed to the second end of the stem. The tip is constructed as an axially compressed piece of steel wire.

BRIEF DESCRIPTION OF THE DRAWINGS

The foregoing and other features of the present invention will become apparent to one skilled in the art to which the present invention relates upon consideration of the following description of the invention with reference to the accompanying drawings, wherein.

DESCRIPTION OF A PREFERRED EMBODIMENT

Figure 1:
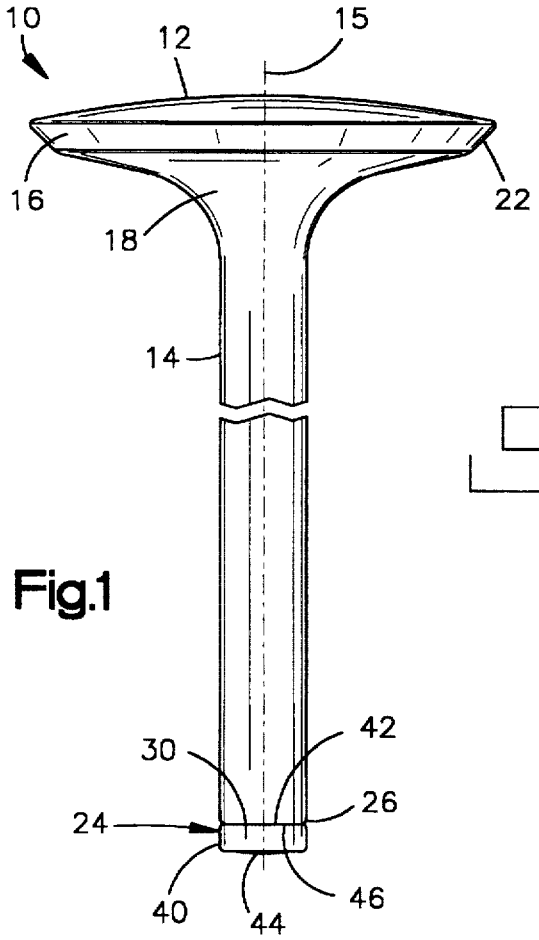
FIG. 1 is a view of a poppet valve comprising a preferred embodiment of the present invention.

A poppet valve 10 comprising a preferred embodiment of the present invention is shown in FIG. 1. The poppet valve 10 has a disc-shaped metal head 12 and an elongated metal stem 14 with a longitudinal central axis 15. A rim surface 16 of the head 12 defines the valve surface which engages a valve seat. A flared neck portion 18 of the stem 14 has an arcuate profile extending radially outward toward the head 12. Various constructions of the head 12, stem 14 and neck 18 are possible. For example, these parts of the valve 10 may be formed as separate pieces or as portions of one continuous piece. A valve tip 24 is welded to the opposite end 26 of the stem 14.

Figure 2:
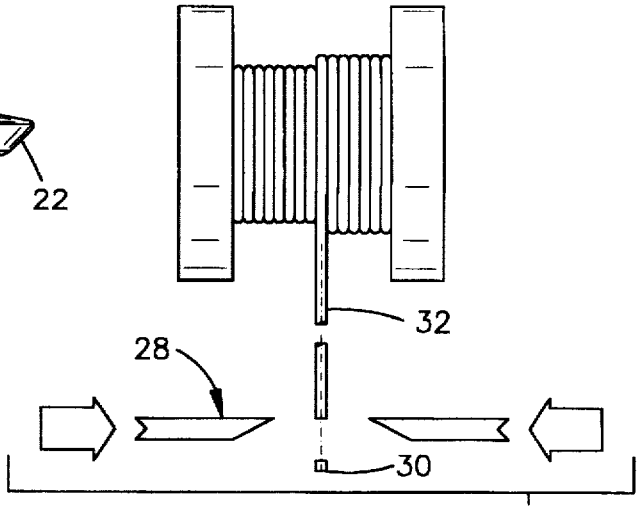
FIG. 2 is a schematic view of an apparatus used to perform a step taken in making the valve of FIG. 1.
Figure 3:
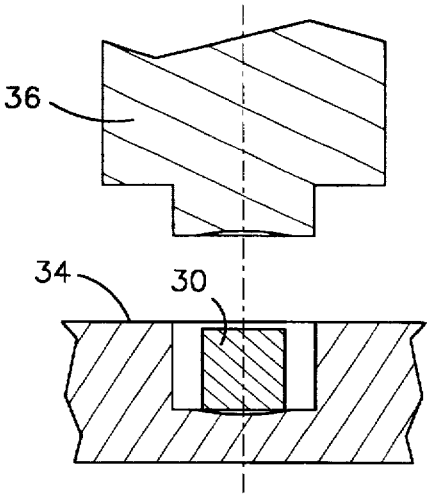
FIG. 3 is a schematic view of an apparatus used to perform a subsequent step taken in making the valve of FIG. 1.
Figure 4:
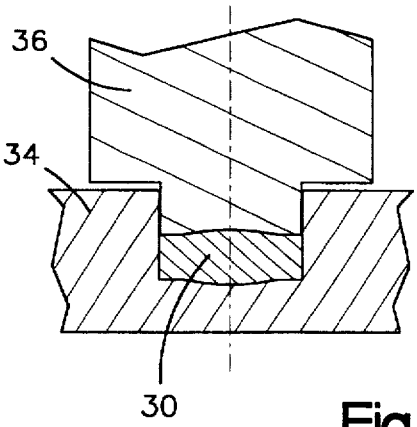
FIG. 4 is a view of the apparatus of FIG. 3 showing parts in different positions.

The valve tip 24 is formed in a header process including the steps shown schematically in FIGS. 2–4. As shown in FIG. 2, a cutting apparatus 28 is used to cut a piece 30 from a supply of steel wire 32. The piece 30 of steel wire may have a length which is greater than the diameter of the steel wire 32, but preferably a length which is approximately equal to or slightly less than the diameter of the steel wire 32.

As shown schematically in FIGS. 3 and 4, the piece 30 of steel wire is placed between a pair of opposed dies 34 and 36, and is compressively loaded axially between the dies 34 and 36. The piece 30 of steel wire is thus subjected to an axially compressive load which is great enough to reduce the length of the piece 30, and simultaneously to increase the diameter of the piece 30. This cold working of the steel material increases the rigidity of the piece 30. The valve tip 24 of FIG. 1 is thus formed as an axially compressed piece 30 of steel wire having a wafer-like configuration, as shown separately in FIG. 5.

Figure 5:
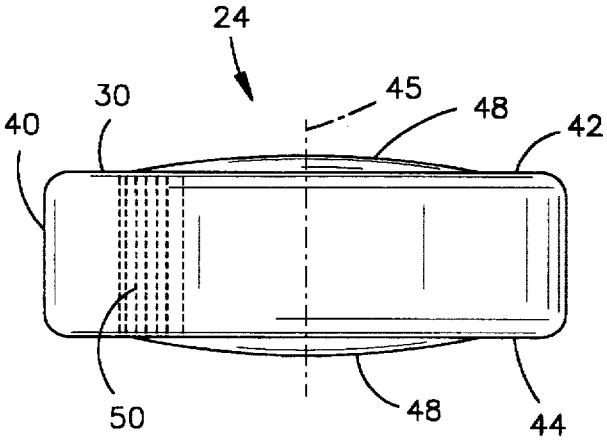
FIG. 5 is a view of a part of the valve of FIG. 1 which is formed in the manner shown schematically in FIGS. 2–4.

More specifically, the valve tip 24 of FIG. 5 is a short, generally cylindrical part with a narrow cylindrical side surface 40 and a pair of circular opposite end surfaces 42 and 44, each of which is centered on a longitudinal axis 45. The end surfaces 42 and 44 are alike so that the valve tip 24 can be welded coaxially to the stem 14 with either of the end surfaces 42 and 44 abutting a circular end surface 46 of the stem 14. In accordance with a particular feature of the present invention, the dies 34 and 36 form the end surfaces 42 and 44 of the tip 24 with convex central portions 48. This configuration helps to ensure effective contact of the abutting end surfaces 46 and 42 (or 44) for resistance welding of the tip 24 to the stem 14. Grinding can be used as needed to finish the welded structure.

The foregoing method of forming the valve tip 24 is simpler and less costly than a milling process. Another advantage of the invention relates to the fact that steel wire 32 may include longitudinally extending "stringers" of non-metallic components such as oxides and sulfides. Such stringers 50 are indicated schematically by the dashed lines shown in FIG. 5. When the poppet valve 10 of FIG. 1 is reciprocated longitudinally in an internal combustion engine, the valve tip 24 is subjected to axially compressive loading as an engine part, such as a cam or lever, slides against the end surface 44 of the tip 24. Since the stringers 50 of non-metallic material extend longitudinally through the tip 24 between the opposite end surfaces 42 and 44, the compressive forces directed against the tip 24 act in directions generally parallel to the stringers 50. In this arrangement, the metallic material of the tip 24 can bear the resulting compressive stresses continuously between the opposite end surfaces 42 and 44. This is an advantage over prior art valve tips that are stamped from sheet metal, because non-metallic stringers extend through sheet metal in directions parallel to the opposite side surfaces of the sheet metal. The stringers thus extend transversely through a stamped valve tip in directions parallel to the opposite end surfaces of the stamped valve tip. The transversely extending stringers interrupt the load-bearing metal material between the opposite end surfaces of the stamped valve tip. This can result in cracking of the stamped valve tip when axially compressive stresses become concentrated at the locations of the stringers. Another advantage that the compressed wire valve tip 24 has over a stamped valve tip is the elimination of the waste that results from stamping circular pieces from a sheet.

From the above description of the invention, those skilled in the art will perceive improvements, changes and modifications. For example, the valve tip 24 in the preferred embodiment of the invention is mounted on the end of a solid valve stem 14, but could be mounted on the end of a hollow valve stem. Such improvements, changes and modifications within the skill of the art are intended to be covered by the appended claims.

Having described the invention, the following is claimed:

1. A poppet valve comprising:

an elongated valve stem having first and second ends;

a valve head at said first end of said stem; and a valve tip fixed to said second end of said stem, said tip comprising an axially compressed piece of steel wire.

2. A poppet valve as defined in claim 1 wherein said tip is a generally cylindrical part with convex opposite end surfaces, said tip being fixed to said stem by a resistance weld between an end surface of said stem and one of said end surfaces of said tip.

3. A poppet valve as defined in claim 2 wherein the length of said tip is not greater than the diameter of said tip.

4. A method of making a poppet valve having a stem, a head at a first end of the stem, and a tip at a second end of the stem, said method comprising the steps of:

forming the valve tip by cutting a piece of steel wire from a supply of steel wire, and by subjecting said piece to an axially compressive load great enough to reduce the length and simultaneously to increase the diameter of said piece; and welding said valve tip concentrically on the second end of the valve stem.

5. A poppet valve as defined in claim 4 wherein said tip is formed as a generally cylindrical part with convex opposite end surfaces, said welding step providing a weld between an end surface of the valve stem and one of said end surfaces of said tip.

6. A method as defined in claim 5 wherein said forming step provides said tip with a length not greater than the diameter of said tip.

* * * * *